United States Patent [19]

Hashimoto et al.

[11] Patent Number: 4,927,131

[45] Date of Patent: May 22, 1990

[54] SHEET STACKING APPARATUS

[75] Inventors: Hiroshi Hashimoto, Tokyo; Hiromichi Yamanaka, Higashiyamato, both of Japan

[73] Assignee: Canon Kabushiki Kaisha, Tokyo, Japan

[21] Appl. No.: 418,764

[22] Filed: Oct. 6, 1989

Related U.S. Application Data

[63] Continuation of Ser. No. 81.134, Aug. 3, 1987, abandoned.

[30] Foreign Application Priority Data

| | | | |
|---|---|---|---|
| Aug. 4, 1986 | [JP] | Japan | 61-183022 |
| Aug. 4, 1986 | [JP] | Japan | 61-183023 |
| Aug. 4, 1986 | [JP] | Japan | 61-183161 |
| Jan. 20, 1987 | [JP] | Japan | 62-012108 |

[51] Int. Cl.[5] ..... B65H 31/10

[52] U.S. Cl. ..... 271/215; 271/217

[58] Field of Search ..... 271/214, 215, 217

[56] References Cited

U.S. PATENT DOCUMENTS

| | | | |
|---|---|---|---|
| 2,707,142 | 4/1955 | Waite | 271/215 X |
| 4,390,175 | 6/1983 | Takahashi | 271/215 X |
| 4,455,115 | 6/1984 | Alger | 271/217 X |

*Primary Examiner*—Richard A. Schacher

*Attorney, Agent, or Firm*—Fitzpatrick, Cella, Harper & Scinto

[57] ABSTRACT

A sheet stacking apparatus includes a sheet discharge outlet, sheet stacker for receiving sheet materials discharged through the sheet discharge outlet, a support for supporting the sheet stacker for substantially vertical movement, or driver for moving the sheet stacker in a substantially vertical direction, a control device for controlling the driver to move the sheet stacker down in the substantiallly vertical direction through a predetermined distance each time a predetermined amount of the sheet materials is stacked on the sheet stacker, and a detector for detecting fullness of the sheet stacker by detecting the sheet stacker at a lower limit level which is changed in accordance with sizes of the sheet materials.

14 Claims, 13 Drawing Sheets

SHEET STACKING APPARATUS

This application is a continuation of application Ser. No. 081,134, filed Aug. 3, 1987, now abandoned.

FIELD OF THE INVENTION AND RELATED ART

The present invention relates to a sheet stacking apparatus usable with an image forming apparatus such as a copying machine and a laser beam printer, more particularly to a sheet stacking apparatus having a stacking portion movable in accordance with the amount of stacked sheets.

It is conventional that an amount of the sheets stacked on the stacking portion is detected by the number or the thickness (height) of the sheets stacked on the stacking portion, and when it reaches a predetermined level, it is deemed that the stacking portion is full, whereupon it is displayed on an operation panel of the image forming apparatus, as disclosed in Japanese Laid-Open Patent Application No. 12569/1986, for example.

Recently, a high speed image forming apparatus, such as a laser beam printer, which can be used for various sizes of sheets has become used more widely than before. With this trend, a sheet stacking apparatus for stacking the sheets discharged from the laser beam printer is required to meet various sizes of the sheets with the capability of stacking a large amount of sheets. Therefore, the sheet stacking apparatus is required to have both a strength durable to the weight of the maximum size sheets stacked to the full capacity and means for assisting alignment of the minimum size sheets stacked to the full capacity. However, an ordinary user uses a predetermined size or sizes of the sheets between the maximum size and the minimum size. It is, therefore, desirable that the stacking apparatus be capable of stacking a large amount of such predetermined size sheets. If the capacity of the stacking apparatus is such that it is capable of stacking the same number of maximum size or minimum size sheets, the strength of the apparatus has to be increased, or an additional means has to be provided in order to prevent the stack from falling, thus increasing the cost of the apparatus. If, on the other hand, the apparatus is designed to meet the stacking capacity of the minimum size sheets without increasing the cost, the sheet stacking capacity for the sheets of the predetermined size or sizes of sheets is not sufficient.

FIG. 1 is a schematic sectional view of a conventional sheet stacking apparatus, wherein a sheet 4' is discharged by discharging roller 1' through a discharging outlet 2' onto a stacking tray 3'. With the hard copies being outputted through the discharging outlet 2' by the discharging roller, the copies are sequentially stacked on the tray 3', to form a stack of sheets 4'. When the height of the stack increases to such an extent that it reaches a predetermined level adjacent the discharging outlet 2', an unshown tray elevating motor is driven for a predetermined interval of time to lower the stacking tray 3'. The timing of starting to lower the tray is determined on the basis of an unshown sheet surface sensor for detecting that the topmost surface of the stack reaches a predetermined level.

When the copies continue outputting, the elevating motor is operated for the predetermined period of time, each time the top surface reaches the predetermined level, so as to lower the tray. In this manner, when the copies are continuously discharged, the stacking tray 3' lowers intermittently.

FIG. 2 is a flow chart for controlling the stacking tray position in the apparatus of FIG. 1, which will be self explanatory.

Regarding alignment of the discharged sheets on the stacking tray, it is desirable in order to assure the alignment to maintain within a predetermined range the angle at which the sheet discharged through the discharge outlet 2' and coming to contact the topmost of the stacked sheets on the tray 3' is contacted to the topmost sheet. In other words, the distance between the discharge outlet 2' and the topmost surface of the stack is within a predetermined range.

Generally, most of sheet stackers equipped with a lowering tray are capable of receiving a large amount of sheets, so that the weight of the stacked sheets varies over a wide range. Therefore, the load applied to an elevating motor for the stacking tray varies widely. Therefore, the conventional control wherein the sheet surface is detected, on the basis of which the motor is operated for a constant interval involves a problem that the distance between the discharge outlet 2' and the surface of the stack is not maintained within a range of assuring the stacked sheet alignment because the speed of the motor changes depending on the load applied thereto or because, in the case of constant speed motor, the rise time changes depending on the load.

As described hereinbefore, the recent trend toward a high speed image forming apparatus usable with various sizes of sheets, necessiates a sheet stacking apparatus usable with various sizes of sheets and capable of stacking a large amount of sheets. When different sizes of sheets are stacked on the sheet stacking apparatus, the sheets are offset or they fall if the order of the sheet sizes is not proper, as in the case where a predetermined number or more large size sheets (e.g. A3 size) are stacked on a stack of a predetermined number or more of small size sheets (e.g. A5 size).

SUMMARY OF THE INVENTION

Accordingly, it is a principal object of the present invention to provide a sheet stacking apparatus capable of aligning discharged sheets irrespective of the amount of already stacked sheets.

According to an embodiment of the present invention, a position of a stacking tray where the tray is deemed full is changed depending on the sizes of the sheets.

When the sheets of a large or small size are stacked, a first stacking amount detecting means, for example, detects the full position for the large or small size, whereas when the sheets of a middle size are stacked, a second stacking amount detecting means, for example for detecting the full position at a larger amount of the sheets than that of the first stacking amount detecting means detects another full position for the middle size sheets.

Thus, different stacking amount detecting means having different full positions are selectively used depending on the sizes of the sheets, whereby the sufficient stacking capacity for a predetermined size or sizes of the sheets that are most frequently used can be assured, and simultaneously the stacking capacity for the minimum and maximum sizes is as required.

In another embodiment of the present invention, the driving period during which the lowering means for lowering the sheet stacking means is being operated is changed in accordance with the amount of the stacked sheets, so that the satisfactory alignment function can be maintained irrespective of the amount of stacked sheets.

In another embodiment, the sheet stacking apparatus includes means for counting the number of sheets stacked on the stacking tray, and in response to a count the counter, the time period or interval during which a stack lowering means is being driven is changed, so that the satisfactory aligning function is maintained irrespective of the amount of the stacked sheets.

In another aspect of the present invention, when various sizes of sheets are discharged from an image forming apparatus to a stacking tray, the stacked amount is counted for the respective sizes of the sheets, by which when a size of sheets are stacked on a stack of different size sheets, the full position is changed depending on the sheet sizes.

When large size sheets are stacked on a stack of small size sheets already stacked, the control system receives sheet size signals from an image forming apparatus and stacked amount signals from a stacked amount detecting means to count the stacked amounts for each of the sizes, on the basis of which the full state is discriminated.

Thus, when large sheets are stacked on a stack of small size sheets, the full state of the tray is changed depending on the sheet sizes, whereby even when various sizes of sheets are stacked together, the stacking operation is stabilized.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 6:
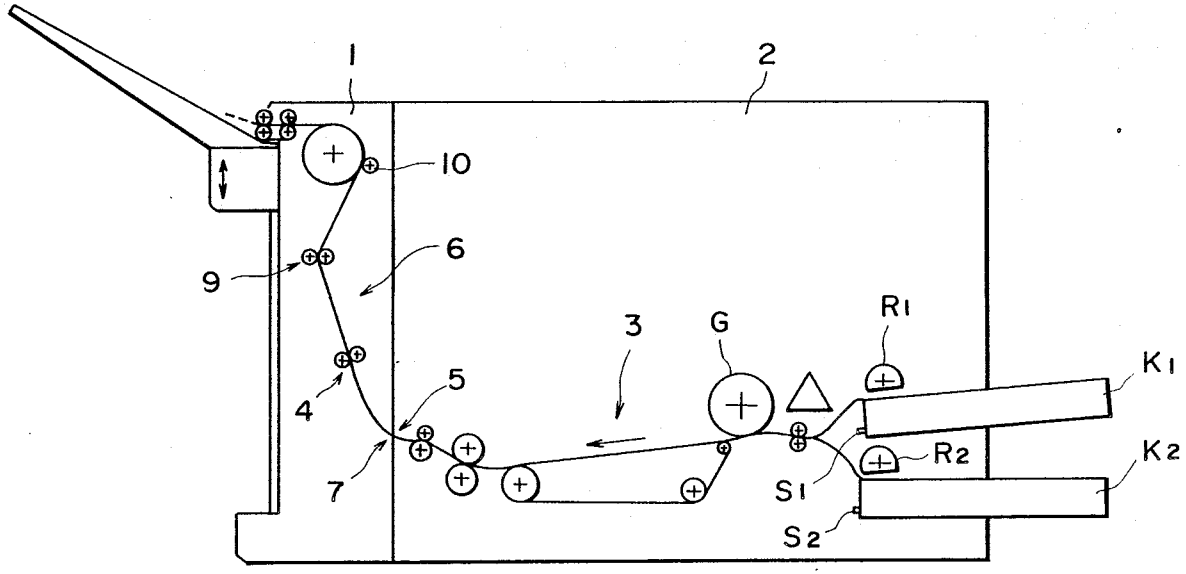
FIG. 6 is a side view showing a correction between the sheet stacking apparatus and an image forming apparatus.

Referring to FIG. 6, a sheet stacking apparatus 1 according to an embodiment of the present invention is shown schematically as being connected with an image forming apparatus 2 which is used with the sheet stacking apparatus 1. As shown, the sheet stacking apparatus 1 is disposed downstream of an exemplary image forming apparatus, that is, a laser beam printer 2 with respect to a general direction of sheet movement. A discharge outlet 5 of the sheet conveying portion of the laser beam printer 2 is substantially at the same horizontal level as the sheet inlet 7 of the sheet conveying portion 6 of the sheet stacking apparatus 1.

Figure 1:
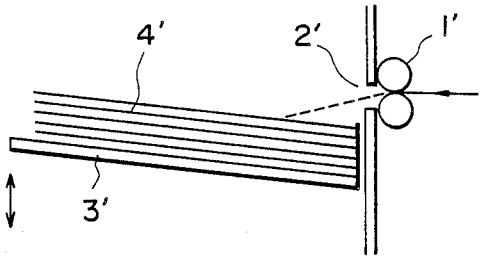
FIG. 1 is a schematic sectional view of a conventional sheet stacking apparatus.
Figure 2:
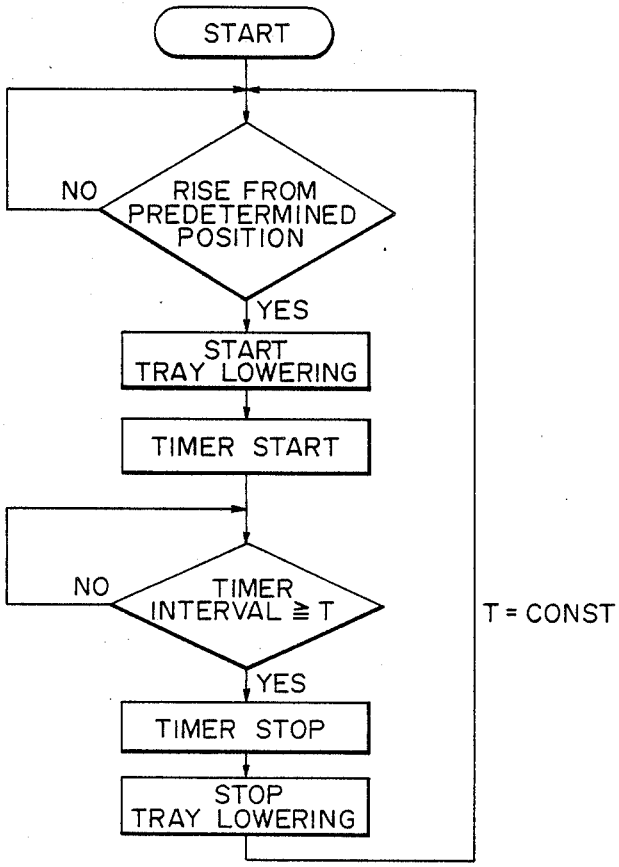
FIG. 2 is a flow chart illustrating a control of lowering the tray of FIG. 1.
Figure 3:
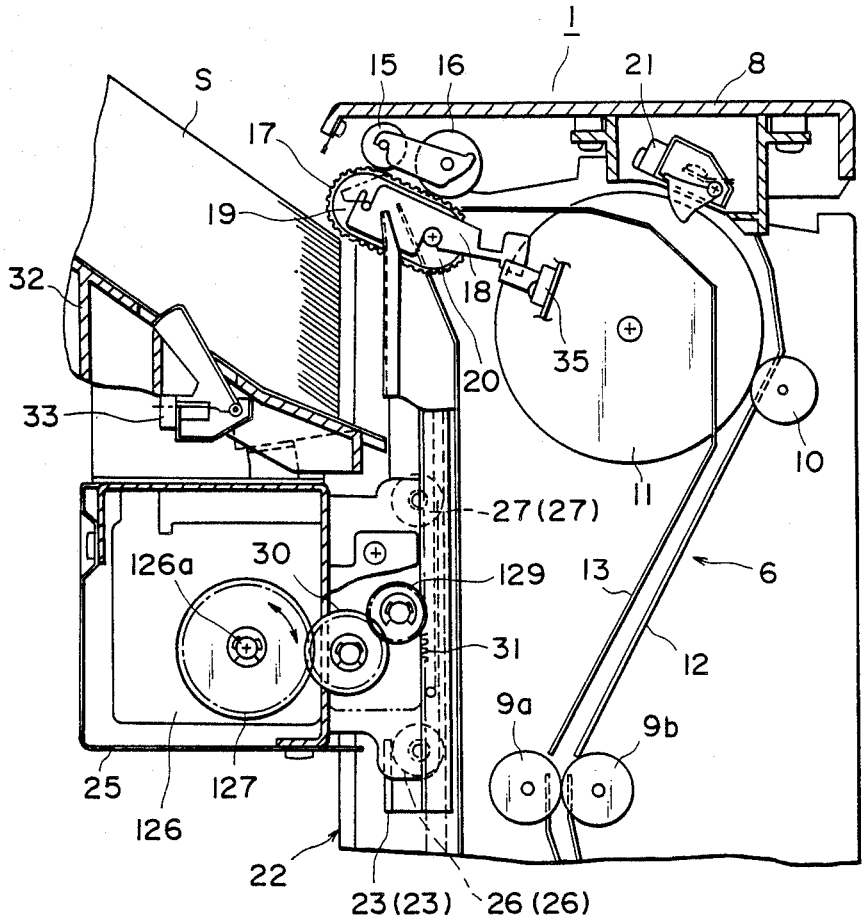
FIG. 3 is a sectional view of a sheet stacking apparatus according to an embodiment of the present invention.

As shown in detail in FIG. 3, the sheet stacking apparatus 1 is provided with the sheet stacking portion 6 in the main frame 8 of the apparatus. The conveying portion 6 includes a couple of conveying rollers as best seen in FIG. 6, couples of conveying rollers 9*a*, 9*b*, 10 and 11, guides 12 and 13, discharging rollers 15 and 16 and discharging rollers 19 and 20 about which a discharging belt 17 is trained. The pair of the discharging rollers 19 and 20 is equipped with a lever 18. A sensor 21 is disposed at an upper portion of the frame 8 of the apparatus. The sensor 21 functions to detect presence or absence of the sheet S in the conveying passage extending from the conveying rollers 10 and 11 to the discharging rollers 16 and 20. A post 22 is extended vertically at a downstream portion of the frame 8, and to the post 22 rails 23 and 23 are fixed. The rails 23 and 23 guide vertical movement rollers 26, 26, 27 and 27 provided on a tray driving portion 25. The tray driver 25 includes a DC motor 126. The output shaft 126*a* of the motor 126 is provided with a gear 127 fixed thereto, the gear 127 being meshed with a pinion 129 through an idle gear 30. The pinion 129 is meshed with a rack 31 which is fixed on the post 22. Therefore, the tray driver 25 is movable substantially vertically by operation of the motor. Above the tray driver 25, there is provided a tray 32 for stacking sheets S, and the tray 32 is provided with a sensor 33 for detecting presence or absence of the sheet S. A sensor 35 is mounted to a frame 8 of the apparatus and is effective to detect the height of the stack of the sheets S by the discharging roller 19 being elevated to a predetermined level by the stacked sheets S on the tray 32. The sensor 35 comprises a light emitting portion and light receiving portion (not shown) and a lever 18 movable together with the discharging roller 19.

Figure 4A:
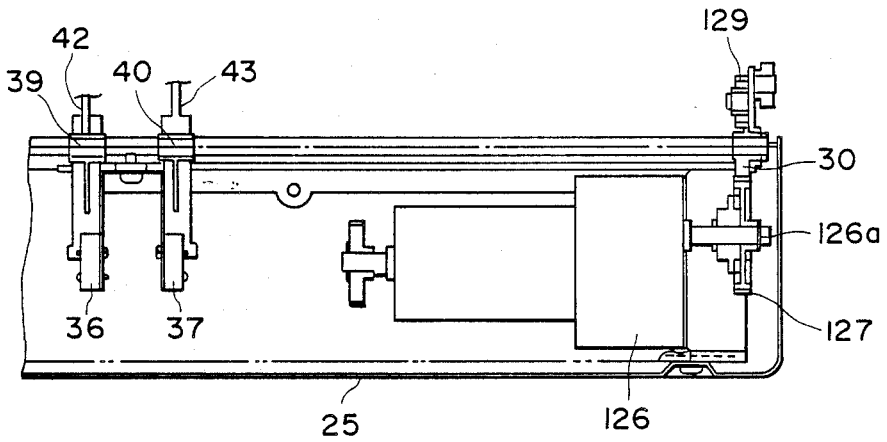
FIG. 4A is a top sectional view of a stacked amount detecting means usable with FIG. 3 apparatus.
Figure 4B:
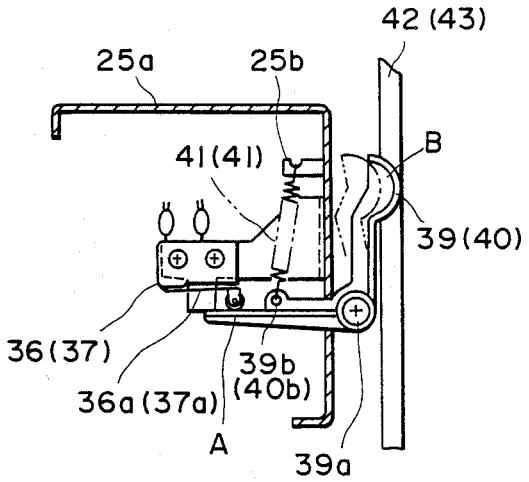
FIG. 4B is a cross-sectional view of the detecting means of FIG. 4A.
Figure 4C:
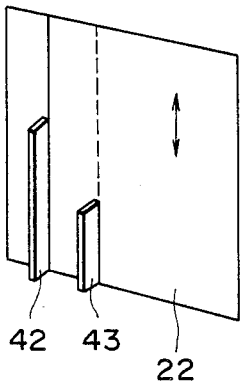
FIG. 4C is a perspective view thereof.

The tray driver 25 is provided with microswitches 36 and 37 for detecting the lowered position of the tray 32, and therefore the amount of the sheets stacked on the tray 32, as shown in FIG. 4. The microswitches 36 and 37 are each provided with a lever 39 or 40 of "L" shape and rotatably supported by a shaft 39*a* in the bent portion. A ring 39*b* (40*b*) is formed adjacent an end of the lever 39 (40). Between the ring 39*b* (40*b*) and a hook 25*b* projected on an inside of a case 25*a* of the tray driver 25, a spring 41 (41) is stretched. Thus, an end portion A (A) of the lever 39 (40) is urged upwardly by the spring 41 (41) to push a lever 36*a* (37*a*) of the microswitch 36 (37).

A rib 42 (43) is extended parallel with and spaced from the post 22. The other end B (B) of the lever 39 (40) is contacted to the rib 42 (43) so that the lever 39 (40) rotates, by which said one end is moved away from the lever 36*a* (37*a*) of the microswitch 36 (37) to open the switch 36 (37).

Figure 5:
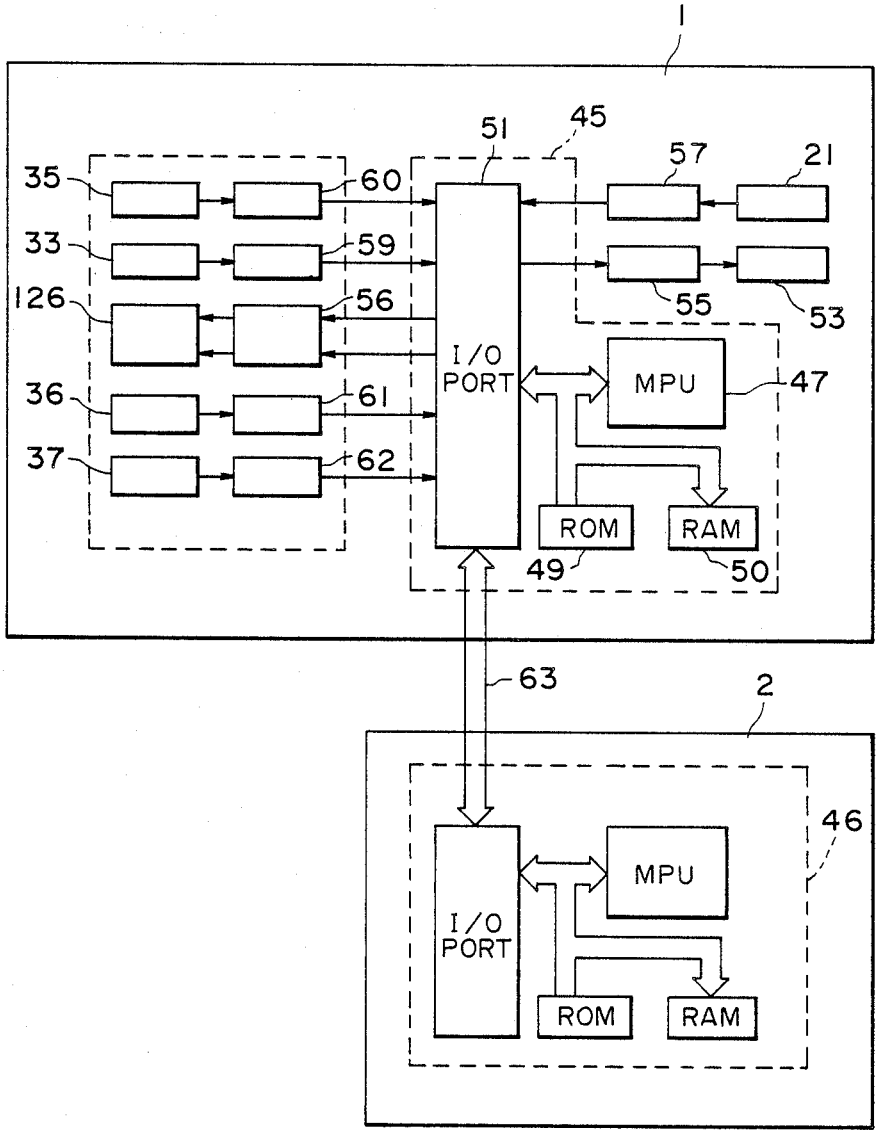
FIG. 5 is a block diagram illustrating a control system of the sheet stacking apparatus.

As shown in FIG. 5, the sheet stacking apparatus 1 and the laser beam printer 2 are provided with control devices 45 and 46, respectively. The control 45 includes a microprocessor 47 for processing data from various parts and for performing entire control of the apparatus 1. The microprocessor 47 includes ROM (read only memory) 49 and RAM (random access memory) 50 and input/output port 51, which are connected by bus line to control a driving motor 53 of the conveying portion 6 and a driving circuit 55 and 56 of the DC motor 126. The input/output port 56 receives signals from the sensors 21, 33 and 35 and signals from the microswitches 36 and 37 by way of buffer memories 57, 59, 60, 61 and 62, and the input/output port is connected with the control 46 of the laser beam printer 2 by the bus line 63.

In operation, a large size sheet S, for example, A3 or B4 sheet or a small size sheet S, for example, A5 or B5 sheet is supplied from a cassette K1 or K2 by a roller R1 or R2 and is subjected to an image forming operation by the laser beam printer 2. The sheet S is then discharged from the sheet conveying portion 3 through a discharge outlet and is introduced into the sheet stacking apparatus 1 through an inlet thereof. The size of the sheet S is detected and is transmitted to the control 45 of the sheet stacking apparatus by a sheet size detecting means such as size information switches S1 and S2 disposed adjacent an outlet side end of the cassette K1 or K2. The sheet S is transported between the guides 12 and 13 by conveying rollers 9*a*, 9*b*, 10 and 11 to between the discharging rollers 12 and 20. At this time, the sheet S is detected by the sensor 21, and the signal from the sensor 21 is transmitted to the microprocessor 47 through the buffer memory and the input/output port 51. The sheet S is discharged onto the tray 32 by the discharging rollers 15, 16, 19 and 20. In the similar manner, a number of sheets S are stacked on the tray 32. When the stack of the sheets S becomes so high that the stack pushes the discharging roller 19 upward to such an extent that the lever 19 interrupts the light from the light emitting portion to the light receiving portion of the sensor 35, the sensor 35 becomes off, thus detecting that the height of the stacked sheets S on the tray 32 reaches a predetermined level. The signal from the sensor 35 is transmitted to the microprocessor 47, in response to which the microprocessor 47 instructs the DC motor 26 to operate to lower the tray driver 25. By this, the tray driver 25 lowers through a predetermined amount to enable the tray to receive the sheets S. In this manner, the tray driver 25 lowers intermittently. When it lowers to such an extent that the end B of the lever 39 is brought into contact with the rib 42, the other end B of the lever 39 is moved away from the lever 36*a* of the microswitch 36, thus opening the microswitch 36. The signal from the microswitch 36 is transmitted to the microprocessor 47 through the buffer memory 61. The microprocessor 47 discriminates on the basis of the signal that the stacking tray 32 is full and notifies the laser beam printer control 46 of the fullness through the bus line 63. The control then displays on an unshown operation panel of the laser beam printer the fullness of the stacking tray of the sheet stacking apparatus 1. The operator sees the display and removes the stack of sheets S from the tray 32, in response to which the sensor 33 detects that there is no sheets S on the tray 32. When the signal from the sensor 33 is transmitted to the microprocessor 47 through the buffer memory 59, the microprocessor instructs on the basis of the signal the DC motor 126 to rotate in the upward movement direction. This elevates the tray driver 25 to such an extent that the tray 32 pushes the discharging roller 19 up, and the lever 18 interrupts the light from the light emitting portion to the light receiving portion of the sensor 35, and therefore, the sensor 35 is turned off. The signal from the sensor 35 is transmitted to the microprocessor 49 through the buffer memory 60, and the microprocessor 47, on the basis of the signal, stops the DC motor 26 so as to put the tray 32 in a stand-by position for receiving the sheets S.

Where, on the other hand, the middle size sheets S, for example A4 or B5 size, are discharged, the sheets S are sequentially stacked on the tray 32, and the tray driver 25 intermittently lowers. When the lever 39 is brought into contact with the rib 42 to open the microswitch 36, the signal from the microswitch 36 is transmitted to the microprocessor 47 through the buffer memory 61, but the microprocessor 47 does not produce any instructions. When the sheets S are further stacked on the tray 37, and the tray driver 25 further lowers until the lever 40 is contacted to the rib 43 to open the microswitch 37, the signal from the microswitch 37 is transmitted to the microprocessor 47 through the buffer memory 63. The microprocessor unit 47 then discriminates on the basis of the signal that the tray is full and notifies the fullness to the control 46 through the bus line 63. Subsequently, the control 46 displays in the operation panel of the laser beam printer 2 that the sheet stacking tray of the sheet stacking apparatus 1 is full.

In this embodiment, microswitches 36 and 37 for detecting the position of the tray are used as means for detecting the amount of sheets stacked on the tray 32. However, the detecting means may be of a slide rheostat type, slidable in connection with the movement of the tray 32.

In the embodiment, the amount of sheets is detected on the basis of the position of the tray 32. However, it is a possible alternative that the number of sheets is counted for each of the sheet sizes, and the fullness is detected on the basis of the count. If this is adopted, even if different sizes of sheets are used together, the state of fullness can be discriminated depending on the contents of the different sizes of the sheets. This will be explained in a greater detail hereinafter.

The next embodiment will be described. This embodiment uses the same structure as disclosed in FIGS. 3 and 4, but the control system is different.

Figure 7:
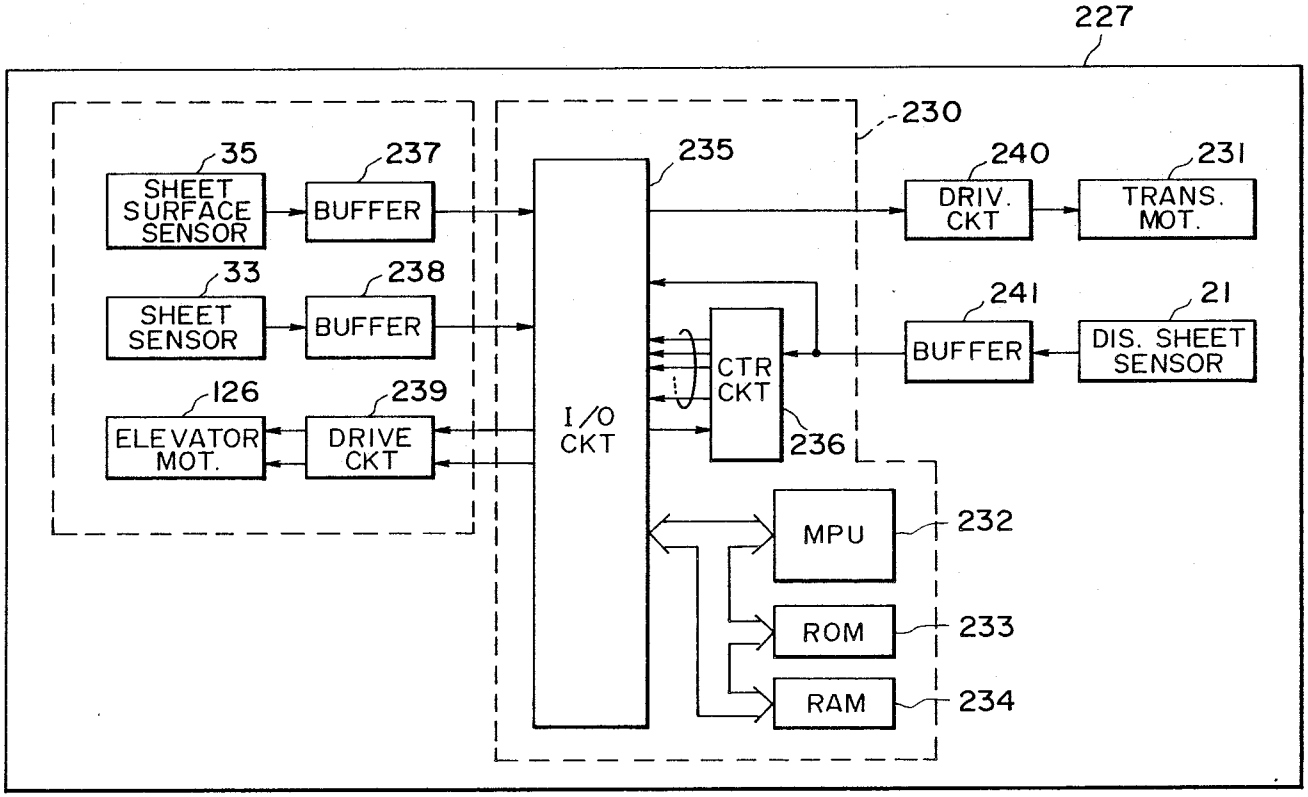
FIG. 7 is a block diagram for a control system of a sheet stacking apparatus according to another embodiment of the present invention.

Referring to FIG. 7, there is shown a block diagram of the control system. The sheet stacking apparatus 227 according to this embodiment is provided with a control device 230 and with a conveyer motor 231 (not shown in FIG. 3) for supplying drive to the conveying rollers 9*a*, 9*b*, 10 and 11 and discharging rollers 15, 16, 19 and 20. The control device 230 includes a microcomputer 232, ROM 233 for storing programmed information for operating the microcomputer 232, RAM for storing and supplying information under the control of the microcomputer 232, input/output port for receiving information of the sheet stacking apparatus and producing output signals under the control of the microcomputer and a counter circuit 236 for counting the number of discharged sheet passed by a discharge sheet sensor 21 on the basis of the information from the discharge sheet sensor 21.

In the structure of the combination of FIG. 3 and FIG. 7 arrangements, when a hard print or copy is discharged from the printer or the like to the sheet stacking apparatus of this embodiment, the discharged sheet is conveyed through the guides 13 and 12 by conveying rollers 9a and 9b to the conveying rollers 10 and 11, from which the sheet is further conveyed to the outlet rollers 15, 16, 19 and 20. The discharge sheet sensor 21 is on, when it senses the presence of the sheet, while it is off when there is no sheet.

Therefore, when plural sheets are outputted, the discharge sheet sensor 21 repeats on/off operation. By counting the number of changes of the sheet sensor from off-state to on-state, the number of the discharged sheets which will constitute a stack can be discriminated. The counting is performed by the counting circuit 236. The counter circuit 236 has a function of adding one for each of the sensor changes from the off-state to the on-state and also a function of clearing the counter to restore the count to zero in response to a clearing signal which will be described hereinafter. The information of the count by the counter circuits 236 is inputted into the microcomputer 232 through the input/output circuit 235, while the clearing signal for the counter is outputted to the counter circuit 236 through the input/output circuit 235 from the microcomputer 232. When the microcomputer 232 discriminates that there is no sheet on the tray 32 on the basis of the sheet sensor 33, it produces a count clearing signal. In this manner, the microcomputer 232 possesses the information of the number of stacked sheets S on the tray 32 at any time.

Figure 9:
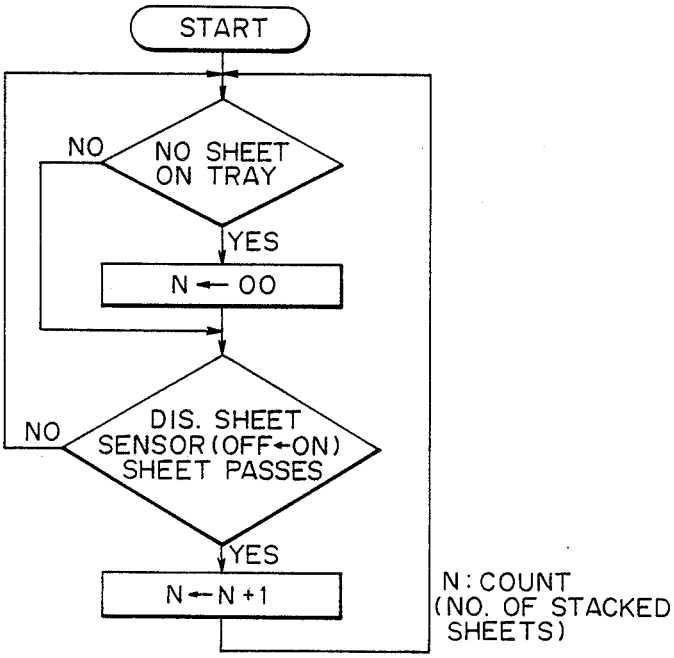
FIG. 9 is a flow chart illustrating an operation of counting the stacked sheets.

FIG. 9 is a flow chart illustrating the counting operation.

The sheet reaching the outlet rollers 15, 16, 19 and 20 is further conveyed by those rollers and is discharged onto the topmost of the stacked sheets on the tray 32. With continued discharge of the sheets, the level of the topmost sheet rises, by which the discharge roller 19 is elevated. When the discharge roller 19 reaches a predetermined level, the event is detected by the control device 236 on the basis of the input from the sheet surface sensor 35, whereupon the tray elevating motor 25 is driven so as to lower the tray 32 by rotating the gear 127 in the counterclockwise direction.

The time period during which the motor is operated is determined in accordance with the count of the counter circuit 236, that is, the number of the sheets currently stacked on the tray 32. Generally, the weight of the stack increases with the number of the sheets in the stack, and therefore, the load of the motor decreases due to the influence of the gravity as long as the tray is lowered by the motor; the rotational speed of the DC motor without constant rotational speed control system increases with the result that the amount of the tray lowering per unit time increases.

Figure 8:
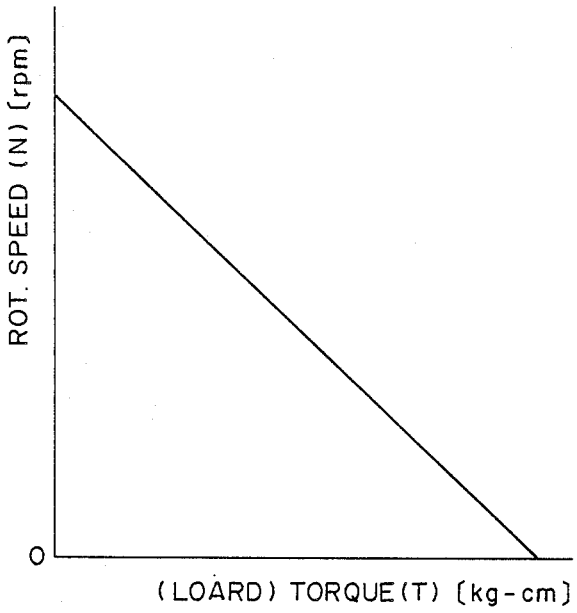
FIG. 8 is a graph indicating a relationship between a torque of a DC motor and a rotational speed.

FIG. 8 shows an example of the relationship of a rotational speed VS and a torque of a DC motor. According to this embodiment, the time period of motor operation is decreased in accordance with the increase of the number of sheets stacked on the tray, so that the lowered amount of the tray is made constantly over a wide range including the time when the tray stacks a small number of sheets and the time when it stacks a large number of sheets. In this manner, the positional relation between the discharge outlet and the topmost surface of the stacked sheet can be maintained with a predetermined range assuring the satisfactory stacking and aligning performance.

Figure 10:
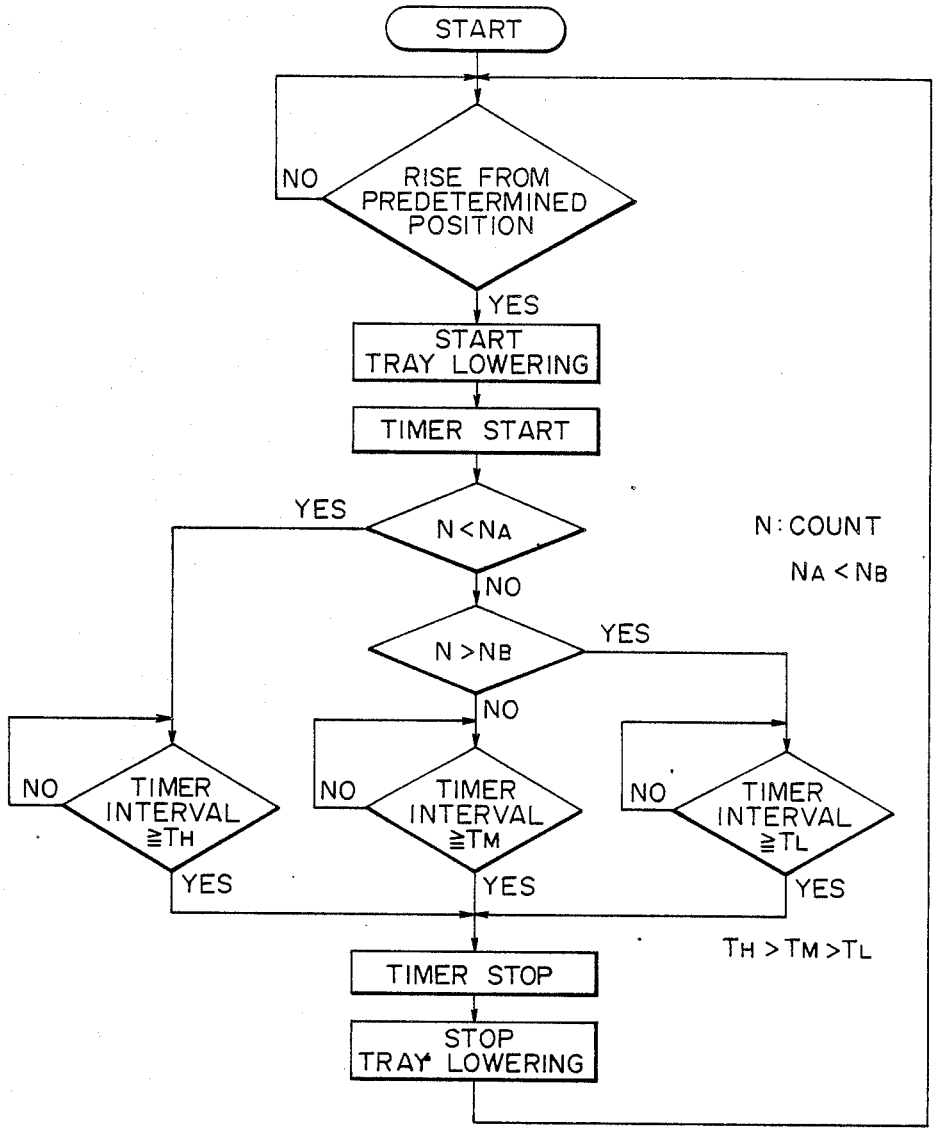
FIG. 10 is a flow chart illustrating a control system for lowering the tray.

FIG. 10 is a flow chart of the control system, where the motor driving period in the case of lowering the tray 32 is changed in three stages; the time periods $T_{H(S)}$, $T_{M(S)}$ and $T_{L(S)}$ when the numbers of the stacked sheets (N) are $N \leqq N_A$, $N_A < N < N_B$ and $N_B \leqq N$, respectively ($N_A < N_B$) In order to provide satisfactory stacking and alignment, it is not absolutely necessary that the distance between the discharge outlet and the topmost surface of the stack is maintained at a determined level, but it will suffice if the distance is within a predetermined range, usually 2–3 mm; and therefore the time periods may be changed discontinuously.

Figure 11:
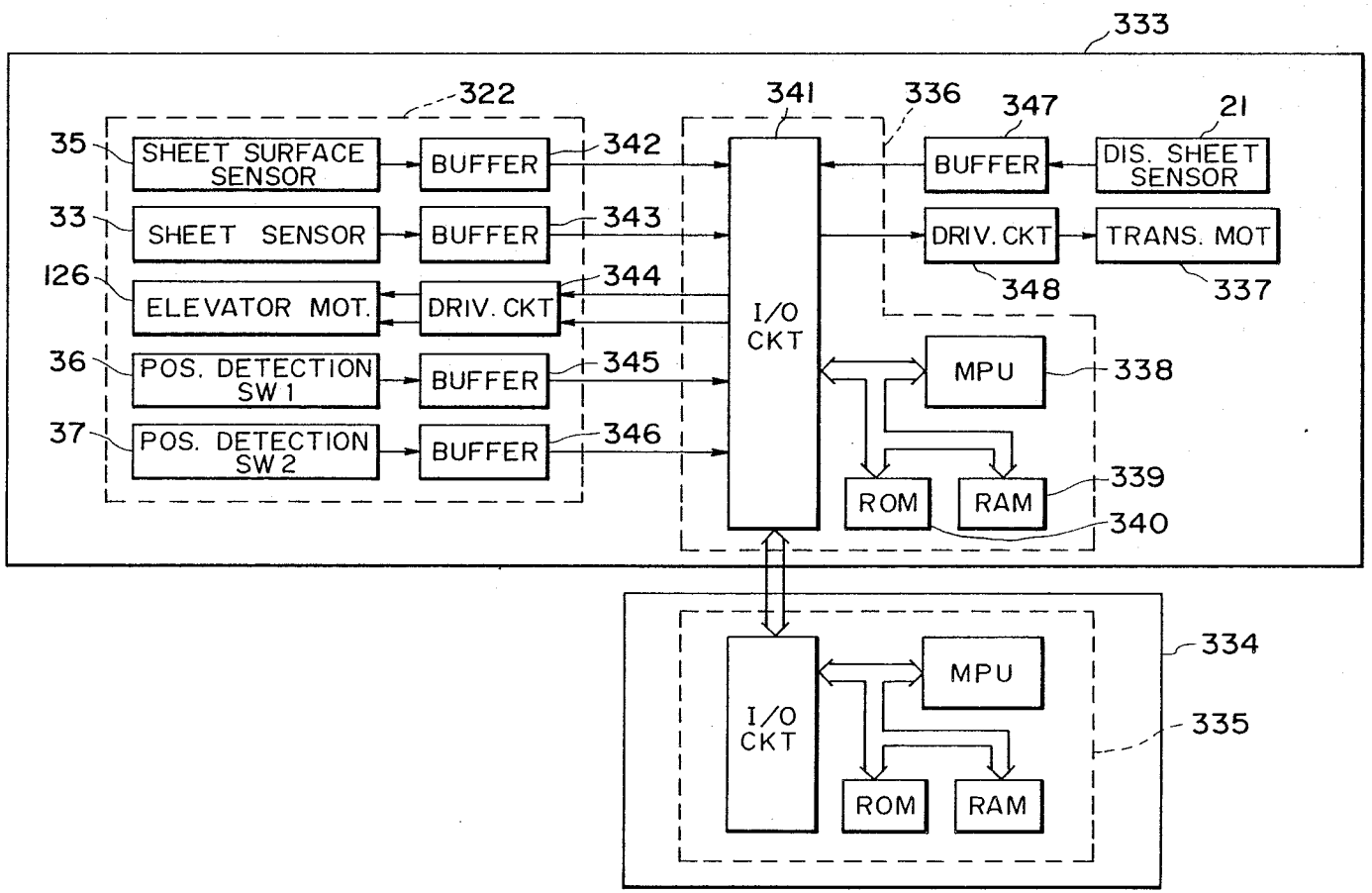
FIG. 11 is a block diagram of a control system for a sheet stacking apparatus according to a third embodiment of the present invention.

Referring to FIG. 11, a further embodiment of the present invention will be described. FIG. 11 shows a block diagram usable with the arrangements shown in FIGS. 3, 4 and 6. The stacking apparatus 333 is usable with a hard copy outputting apparatus such as a printer or the like having a control device 334. The stacking apparatus 333 is provided with a control device 336. The stacking apparatus 337 includes a conveying motor for supplying driving power for conveying the sheet. The control device of the stacking apparatus includes a microcomputer 338, RAM 339 for storing information from the microcomputer, a ROM 340 for storing programmed information for operating the microcomputer and an input/output circuit for receiving and supplying signals under the control of the microcomputer.

In operation, outputted to the stacking apparatus 333 is conveyed through the guides 13 and 12 to conveying rollers 9a, 9b, 10 and 11 and reaches the discharge rollers 15, 16, 19 and 20, by which the sheet is discharged onto the tray 32 or onto the topmost sheet of the stack of the sheets already discharged. With continued stacking operation, the topmost surface of the stack rises, by which the discharge roller 19 is gradually elevated. When the discharge roller 19 reaches a predetermined level, the event is detected by the control 336 on the basis of the input from the sheet surface sensor 35, in response to which the elevating motor 126 operates to lower the tray 32. Counterclockwise rotation of the gear 127 lowers the tray.

In this embodiment, the time period during which the motor is operated is not constant but changes depending on the on/off state of the microswitches 36 and 37. As will be understood from the foregoing description with respect to FIG. 3, the position of the tray 32 may be discriminated in three ranges of the level of the tray 32 by utilizing the on/off state of the microswitches 36 and 37. Here, the motor operating period when the tray 32 is in the topmost range of the level (small stack height) is $T_{H(S)}$; a middle range (intermediate height of stack), $T_{M(S)}$; and a bottom range (large height of stack), $T_{L(S)}$. With increase of the stacked amount of the sheet, the load of the motor decreases as long as tray is lowered, due to the gravity, and therefore the rotational speed of the motor increases with the result that the amount of the tray lowering per unit time increases. Then, in this embodiment, in consideration of the speed/torque property, the time periods are so selected that $T_H > T_M > T_L$ is satisfied. By this, the positional relation between the dischrage outlet and the topmost surface of the stacked sheets is maintained within the range assuring satisfactory stacking and alignment performance over a range between and including large amount stacking and small amount stacking.

Figure 12:
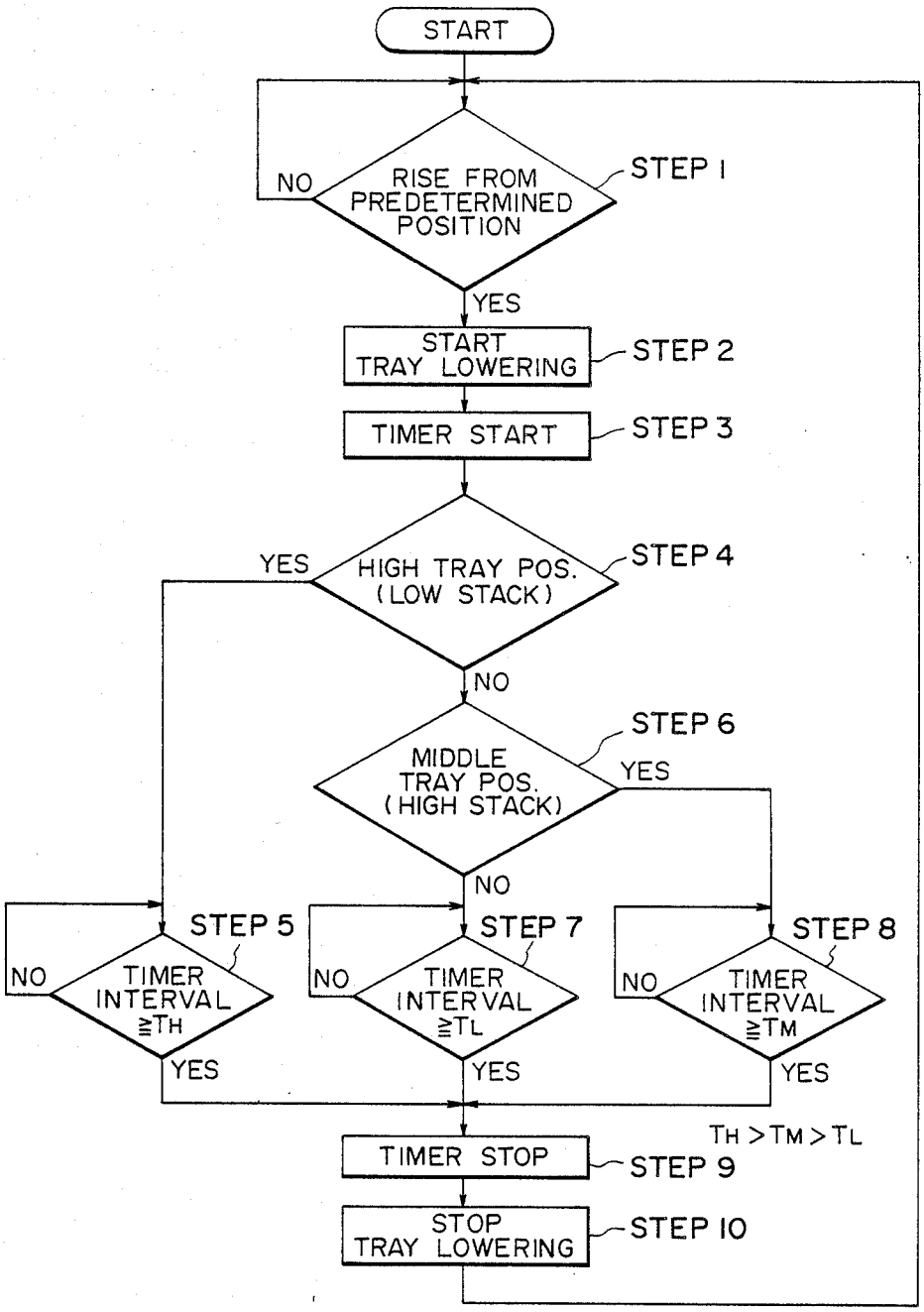
FIG. 12 is a flow chart illustrating a tray lowering control.

FIG. 12 is a flow chart of a control system for performing the above described operation.

In this embodiment, the microswitches are used to detect the position of the tray, but another means may be used for detecting the position of the tray, for example, a slide rheostat may be usable.

In the description of this embodiment, a single size of the sheets are taken. However, the apparatus of this embodiment is applicable to the case of various sheet sizes used, by setting $T_H$, $T_M$, $T_L$ for different sizes. In this case, for example, the time period $T_H$ for A3 sheets is smaller than the time period for A4 sheets.

Figure 13:
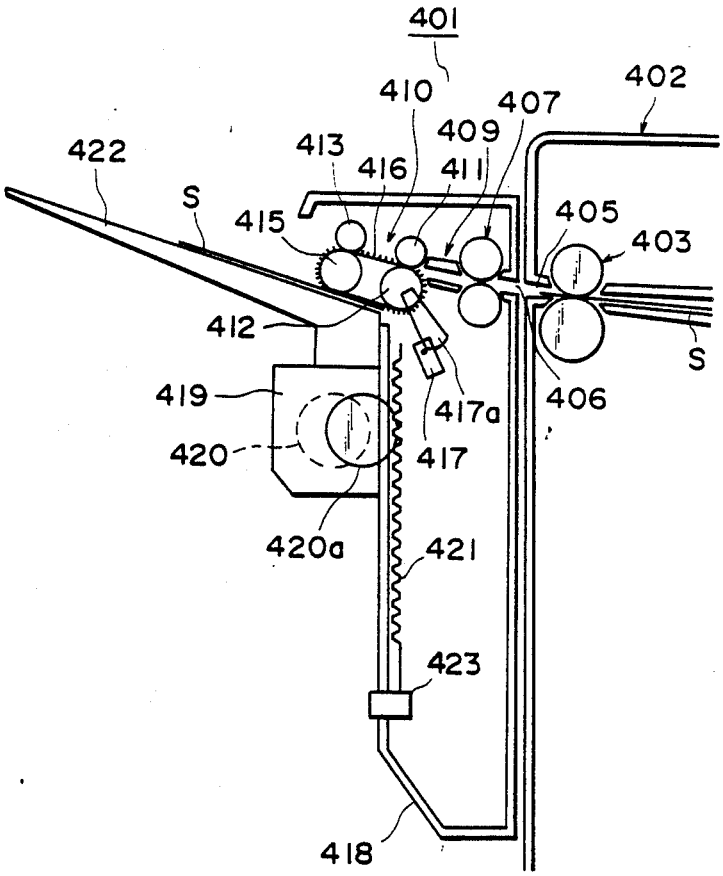
FIG. 13 is a front sectional view of a sheet stacking apparatus according to a fourth embodiment of the present invention.

Referring to FIG. 13, a further embodiment of the present invention will be described. The sheet stacking apparatus 401 is disposed downstream of an image forming apparatus 402 with respect to movement of sheet discharge. A discharge outlet 405 downstream of a discharging roller couple 403 of the image forming apparatus 402 is substantially at the same horizontal level with an inlet 406 of the sheet stacking apparatus 401. Downstream of the inlet 406, there are a couple of conveying rollers 407 and a couple of guides 409, and downstream of the guide 409 is a sheet discharging portion 410. The sheet discharging portion 410 includes discharging rollers 411, 412, 413 and 415 and sheet discharging belt 416 trained about two of the rollers 412 and 415. The assembly constituted by the discharging rollers 413 and 415 and the discharging belt 416 is supported pivotably about a shaft of the discharging roller 412. A sheet surface sensor 417 is disposed adjacent the roller 412 and is turned on and off by a lever 417*a* in response to a pivotting action of the discharge belt 416. In a left portion of the main frame 418 of the apparatus, a tray assembly 419 is supported for substantially vertical movement, and the tray assembly 419 is provided with a gear 420 connected to a motor 420. On the other hand, the tray assembly 418 has a rack 421 which is meshed with the gear 420. In an upper portion of the tray assembly 419, there is provided a tray 422 for receiving and stacking discharged sheets S. Under the rack 421, a lower limit sensor 423 is disposed to detect the lowermost position of the discharge tray 422.

Figure 14:
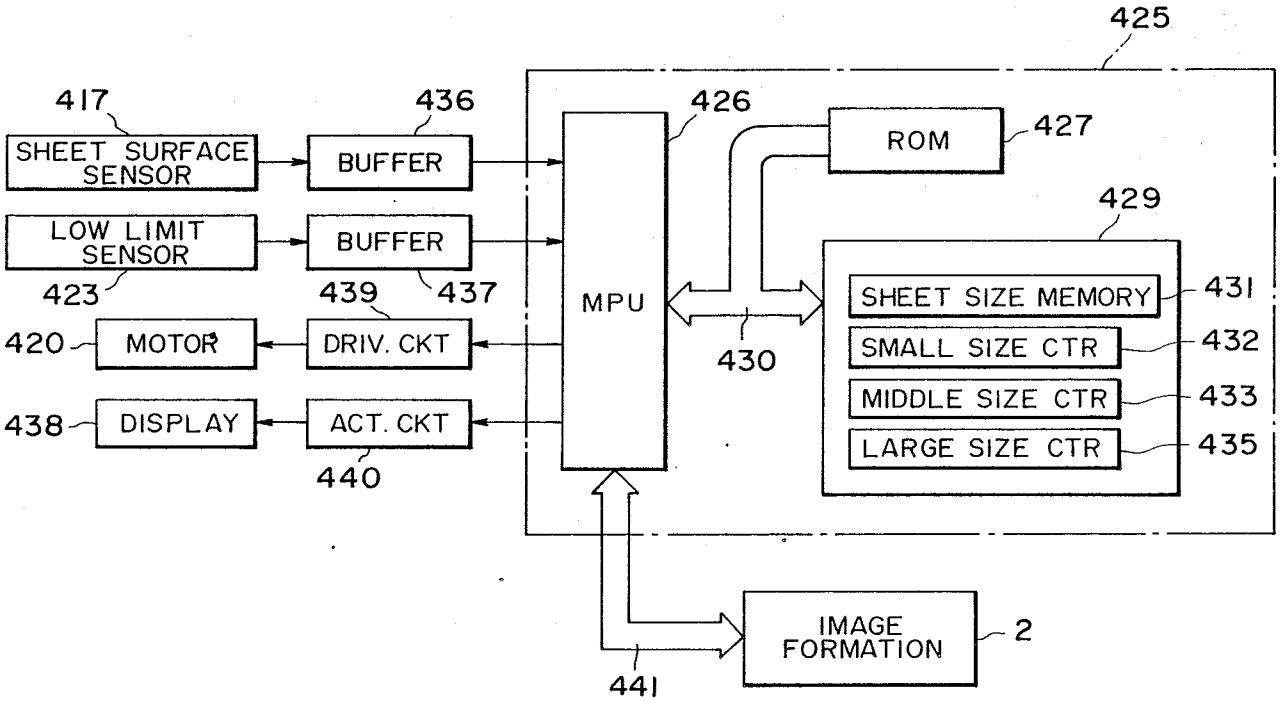
FIG. 14 is a block diagram for illustrating a control system.

As shown in FIG. 14, the sheet stacking apparatus 401 is equipped with a control 425, which includes a microprocessor 426 for processing data from various portions of the apparatus and for controlling the entire sheet stacking apparatus 401. To the microcomputer 426, ROM 427 and RAM 429 are connected by bus line 430. The RAM 429 includes a sheets size memory 431, a small size counter 432, a middle size counter 433 and a large size counter 435. The microprocessor 426 is provided with an input/output port not shown, to which signals from the sheet surface sensor 417 and the lower limit sensor 423 are transmitted through the respective buffers 436 and 437. On the basis of the information from the sheet surface sensor 417 and the lower limit sensor 423 and the RAM 429, the microprocessor 426 controls a driving circuit 439 for the motor 420 and an operating circuit 440 for the display. The microprocessor 426 and the image forming apparatus 402 are connected by a bus line 441, so that information such as sheet size or the like is obtained from the image forming apparatus 402.

Figure 15:
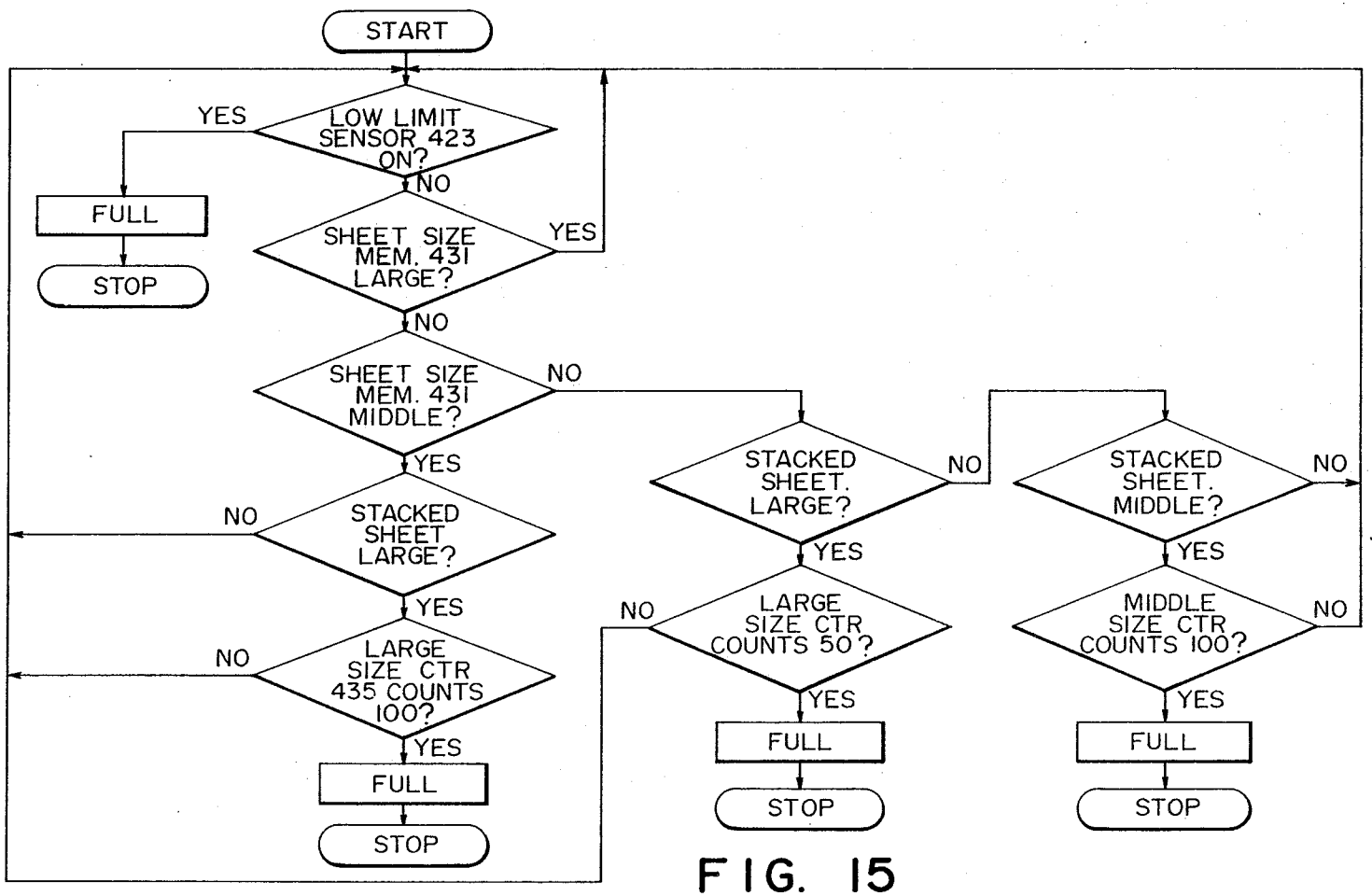
FIG. 15 is a flow chart illustrating an operation of the apparatus.

Referring to FIG. 15, operation of the sheet stacking apparatus according to this embodiment will be described. The microprocessor 426 receives sheet size information from the image forming apparatus 402 and stores it in the sheet size memory 431 so that it memorizes the size of the sheets S stacked on the discharge tray. When the lower limit sensor 423 is off-state, and therefore, the discharge tray 422 is not full, the sheets S which have been subjected to the image forming operation by said image forming apparatus 402 is discharged through the discharge outlet 405. If at this time, the sheet size memory 431 of the microprocessor 426 stores a large size, e.g. A3 or B4 size, the sheet S is conveyed to the discharge portion 410 through the guide 409 by the conveying roller couple 407 and is then discharged by the discharging portion 410 onto the discharge tray 422, irrespective of the size of the sheets being discharged. With repetition of the operation, a number of sheets S are stacked on the discharge tray 422. When the stack of sheets raises the discharge belt 416, the lever 417*a* is brought into the optical path of the sheet surface sensor 417 between its light emitting portion and light receiving portion (not shown), so that the sensor 417 is turned off, thus detecting that the height of the sheets S stacked on the tray 422 is beyond a predetermined limit. The signal from the sheet surface sensor 417 is sent to the microprocessor 426 through a buffer 436, in response to which the microprocessor 426 instructs the motor 420 to rotate in a tray lowering direction to lower the discharge tray 422. Then, the motor 420 rotates to lower the discharge tray 422 by a predetermined distance to enable the tray 422 to receive the next sheets S. In the similar manner, the discharge tray 422 lowers intermittently. When it reaches the lower limit to actuate the lower limit sensor 423, the signal from the sensor 423 is transmitted to the microprocessor 426 through a buffer 437. The microprocessor 426 then discriminates the fullness of the tray, and instructs the operating circuit 440 to display the fullness in the display 438 and also stops the sheet stacking apparatus 401, and in addition, it notifies the image forming apparatus 402 of the fullness through a bus line 441.

When a middle size sheet S or a small size sheet S, e.g. A5 or B6 is discharged under the condition that the sheet size memory 431 stores a middle size, e.g. A4 or B5, a middle size sheet or sheets are stacked on the discharge tray 422, the middle size sheets S or the small size sheets S are allowed to continue discharging on the discharge tray 22 until the lower limit sensor 423 is actuated. On the other hand, a large size sheet S is discharged from the image forming apparatus 402 under the same condition of the sheet size memory 431, the microprocessor 426 instructs the large size counter 435 of the RAM 429 to effect counting action. When the counter 435 counts 100 large size sheets S (the lower limit sensor 423 corresponds more than 100 sheets), the microprocessor 426 deems the tray full. And, the microprocessor 426 displays the fullness in the display 438 by an operating circuit 440, stops the sheet stacking apparatus 401 and notifies the image forming apparatus 402 of the fullness through the bus line 441.

When a small size sheet S is discharged from the image forming apparatus 402 under the condition that the sheet size memory 431 stores a small size, it is discharged and stacked on the discharge tray 422, and the operation is repeated until the lower limit sensor 423 is actuated. On the other hand, when a large size sheet S is discharged from the image forming apparatus 402 under the same condition of the sheet size memory 431, the microprocessor 426 instructs the large size counter 435 of the RAM to count the number of sheets. When the counter 435 counts 50 large size sheets S, the microprocessor 426 discriminates that the tray is full. And, the microprocessor 426 instructs the operating circuit 440 to display the fullness in the display 438, stops the sheet stacking apparatus 401 and notifies the image forming apparatus 402 of the fullness. Further on the other hand, when a middle size sheet S is discharged from the image forming apparatus 402 under the same condition of the sheet size memory 431 (small), the microprocessor 426 instructs the middle size counter 433 of the RAM 429 to count the number of sheets. When the counter 433 counts 100 middle size sheets S, the microprocessor 426 discriminates that the tray is full. And, the microprocessor 426 instructs the operating circuit 440 to display the fullness in the display 438, stops the sheet stacking apparatus 401 and notifies the image forming apparatus 402 of the fullness through the bus line 441.

The above manner of discrimination is summarized in the following Table.

TABLE

| SIZE OF SHEET ALREADY ON TRAY 422 | SIZE OF ON-COMING SHEET TO TRAY 422 | | |
|---|---|---|---|
| | LARGE (L) | MIDDLE (M) | SMALL (S) |
| LARGE (L) | A PREDETERMINED NO. (SWITCH 423) | A PREDETERMINED NO. (SWITCH 423) | A PREDETERMINED NO. (SWITCH 423) |
| MIDDLE (M) | STOP AT 100 SHEETS | A PREDETERMINED NO. (SWITCH 423) | A PREDETERMINED NO. (SWITCH 423) |
| SMALL (S) | STOP AT 50 SHEETS | STOP AT 100 SHEETS | A PREDETERMINED NO. (SWITCH 423) |

In the description of this embodiment, the size of the sheets are large, middle and small, but more sizes may be incorporated.

In this embodiment when different sizes of sheets S are stacked together, the counting of different size sheets S starts from the first. However, if such a small number of different size sheets that the state of stacking is not influenced are discharged in a part of the period during which a number of sheets of two or more sizes are being stacked, the number of said different size sheets S is not necessarily counted.

The fourth embodiment described above may contain the feature or features of the first, second and third embodiments. For example, the motor operating period for lowering the stack may be changed in accordance with the amount of the sheets stacked on the tray, or the lower limit may be changed in accordance with the sheet size.

While the invention has been described with reference to the structures disclosed herein, it is not confined to the details set forth and this application is intended to cover such modifications or changes as may come within the purposes of the improvements or the scope of the following claims.

What is claimed is:

1. A sheet stacking apparatus, comprising:

a sheet discharge outlet;

sheet stacking means for receiving sheet materials discharged through said sheet discharge outlet;

means for supporting said sheet stacking means for substantially vertical movement;

driving means for moving said sheet stacking means in a substantially vertical direction;

control means for controlling said driving means to move said sheet stacking means down in the substantially vertical direction through a predetermined distance each time a predetermined amount of the sheet materials is stacked on the sheet stacking means; and detecting means for detecting fullness of said sheet stacking means by detecting said sheet stacking means at a lower limit level which is changed in accordance with sizes of the sheet materials.

2. An apparatus according to claim 1, wherein said detecting means includes plural fixed detecting elements fixedly disposed at different vertical levels for different sizes of the sheet materials below said discharging outlet and plural movable detecting elements, each of which corresponds to one of the fixed detecting elements and which are movable together with said sheet stacking means.

3. An apparatus according to claim 2, wherein said movable detecting elements include switches.

4. An apparatus according to claim 3, wherein said fixed detecting elements are ribs having different lengths disposed cooperable with said plural stitches.

5. An apparatus according to claim 4, wherein one of the ribs for detecting the lower limit level for the large or small size sheet is longer than another rib for detecting the lower limit level for the middle size sheet.

6. An apparatus according to claim 3, wherein said stitches are mounted on said supporting means.

7. An apparatus according to claim 6, wherein an response to a size signal for the sheet to be discharged, an associated switch is enabled, and the rest thereof is disabled.

8. An apparatus according to claim 1, wherein said detecting means includes counting means for counting a number of sheet materials stacked on said sheet stacking means and for producing a signal indicative of the fullness of said stacking means, using a count thereof.

9. An apparatus according to claim 1, further comprising means for changing the period during which said driving means is operated, in accordance with the amount of sheet materials stacked on said sheet stacking means.

10. An apparatus according to claim 9, wherein said changing means includes detecting means for detecting the vertical level of said stacking means and changes said operating period on the basis of the position detected by said detecting means.

11. An apparatus according to claim 9, wherein said changing means including means for counting the number of sheet materials stacked on said stacking means and changes said operating period on the basis of a count of said counting means.

12. A sheet stacking apparatus, comprising:

a sheet discharge outlet;

sheet stacking means for receiving sheet materials discharged through said sheet discharge outlet;

means for supporting said sheet stacking means for substantially vertical movement;

driving means for moving said sheet stacking means in a substantially vertical direction;

control means for controlling said driving means to move said sheet stacking means down in the substantially vertical direction through a predetermined distance each time a predetermined amount of the sheet materials is stacked on the sheet stacking means;

counting means for counting an amount of the sheet materials received by said sheet stacking means; and detecting means for detecting fullness of said stacking means by detecting said sheet stacking means at a lower limit level which is changed in accordance with sizes of the sheet materials and the amount of the sheet materials received by said stacking means when the sheet materials having different sizes are received by said stacking means.

13. An image forming apparatus, comprising:

image forming means for forming images on sheet materials;

a sheet discharge outlet for discharging the sheet materials after being subjected to operation of said image forming means; and a sheet stacking device, including, sheet stacking means for receiving sheet materials discharged through said sheet discharge outlet;

means for supporting said sheet stacking means for substantially vertical movement;

driving means for moving said sheet stacking means in a substantially vertical direction;

control means for controlling said driving means to move said sheet stacking means down in the substantially vertical direction through a predetermined distance each time a predetermined amount of the sheet materials is stacked on the sheet stacking means; and detecting means for detecting fullness of said sheet stacking means by detecting said sheet stacking means at a lower limit level which is changed in accordance with sizes of the sheet materials.

14. An apparatus according to claim 13, further comprising means for changing the period during which said driving means is operated in accordance with the amount of sheet materials stacked on said sheet stacking means.

* * * * *